US009834931B2

(12) United States Patent
Mizoguchi et al.

(10) Patent No.: US 9,834,931 B2
(45) Date of Patent: Dec. 5, 2017

(54) H-SECTION STEEL AND METHOD OF PRODUCING THE SAME

(71) Applicant: NIPPON STEEL & SUMITOMO METAL CORPORATION, Chiyoda-ku, Tokyo (JP)

(72) Inventors: Masaki Mizoguchi, Kimitsu (JP); Kazutoshi Ichikawa, Kimitsu (JP); Manabu Hoshino, Kimitsu (JP); Kazuaki Mitsuyasu, Osaka (JP); Hirokazu Sugiyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 327 days.

(21) Appl. No.: 14/761,186

(22) PCT Filed: Mar. 10, 2014

(86) PCT No.: PCT/JP2014/056135
§ 371 (c)(1),
(2) Date: Jul. 15, 2015

(87) PCT Pub. No.: WO2014/142060
PCT Pub. Date: Sep. 18, 2014

(65) Prior Publication Data

US 2016/0047123 A1 Feb. 18, 2016

(30) Foreign Application Priority Data

Mar. 14, 2013 (JP) ..... 2013-051954

(51) Int. Cl.
*C22C 38/06* (2006.01)
*C22C 38/08* (2006.01)
(Continued)

(52) U.S. Cl.
CPC ..... *E04C 3/06* (2013.01); *B22D 1/00* (2013.01); *B22D 25/02* (2013.01); *C21D 8/00* (2013.01);
(Continued)

(58) Field of Classification Search
None
See application file for complete search history.

(56) References Cited

U.S. PATENT DOCUMENTS

| | | | |
|---|---|---|---|
| 4,990,196 | A | 2/1991 | Tamehiro et al. |
| 6,258,181 | B1 | 7/2001 | Yamamoto et al. |
| 2010/0330387 | A1 | 12/2010 | Yoshida et al. |

FOREIGN PATENT DOCUMENTS

| | | | |
|---|---|---|---|
| CN | 101541994 | A | 9/2009 |
| EP | 0761824 | A2 | 3/1997 |

(Continued)

OTHER PUBLICATIONS

International Search Report dated May 20, 2014 issued in corresponding PCT Application No. PCT/JP2014/056135 [with English Translation].

(Continued)

*Primary Examiner* — Deborah Yee
(74) *Attorney, Agent, or Firm* — Birch, Stewart, Kolasch & Birch, LLP

(57) ABSTRACT

An H-section steel has a predetermined chemical composition in which a thickness of a flange is 100 mm to 150 mm, at a strength evaluation position an area fraction of bainite in a steel structure is 80% or more, yield strength or 0.2% proof strength is 450 MPa or more, tensile strength is 550 MPa or more and 680 MPa or less, at a toughness evaluation position an average austenite grain size in the steel structure is 150 μm or less, and (Mg, Mn)S having a particle size of
(Continued)

0.005 μm to 0.5 μm is included at a density of $1.0\times10^5$ pieces/mm$^2$ to $1.0\times10^7$ pieces/mm$^2$.

4 Claims, 2 Drawing Sheets

(51) Int. Cl.

| | |
|---|---|
| ***C22C 38/14*** | (2006.01) |
| ***C22C 38/16*** | (2006.01) |
| ***C22C 38/18*** | (2006.01) |
| ***C22C 38/28*** | (2006.01) |
| ***C21D 8/00*** | (2006.01) |
| ***B22D 1/00*** | (2006.01) |
| ***B22D 25/02*** | (2006.01) |
| ***E04C 3/06*** | (2006.01) |
| ***E04C 3/04*** | (2006.01) |
| ***C22C 38/00*** | (2006.01) |
| ***C22C 38/58*** | (2006.01) |
| ***C21D 8/02*** | (2006.01) |
| ***C22C 38/02*** | (2006.01) |
| ***C22C 38/04*** | (2006.01) |
| ***C22C 38/12*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |

(52) U.S. Cl.

CPC ..... *C21D 8/0226* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/004* (2013.01); *E04C 2003/0452* (2013.01)

(56) References Cited

FOREIGN PATENT DOCUMENTS

| | | | |
|---|---|---|---|
| EP | 0940477 Al | | 9/1999 |
| JP | A-04-279247 | | 10/1992 |
| JP | 05-263182 | | 10/1993 |
| JP | A-07-090474 | | 4/1995 |
| JP | A-09-194985 | | 7/1997 |
| JP | 10-147835 | | 6/1998 |
| JP | A-11-131188 | | 5/1999 |
| JP | 2000-054060 | | 2/2000 |
| JP | A-2000-080440 | | 3/2000 |
| JP | 2000-328174 | | 11/2000 |
| JP | 2001-003136 | | 1/2001 |
| JP | 2001-11587 | A | 1/2001 |
| JP | 2001-254139 | | 9/2001 |
| JP | 2002-003986 | | 1/2002 |
| JP | 2002-309338 | | 10/2002 |
| JP | A-2003-160833 | | 6/2003 |
| JP | 3507258 | B2 | 3/2004 |
| JP | A-2007-277629 | | 10/2007 |
| JP | 2011-106006 | A | 6/2011 |
| JP | A-2011-106006 | | 6/2011 |
| JP | 2011-157573 | | 8/2011 |
| JP | 2011-202210 | | 10/2011 |
| JP | A-2011-246806 | | 12/2011 |
| JP | 2012-180584 | A | 9/2012 |
| WO | WO 2010/013358 | | 2/2010 |
| WO | WO 2011/065479 | | 6/2011 |
| WO | WO 01/75182 | A1 | 10/2011 |

OTHER PUBLICATIONS

International Search Report dated Feb. 12, 2013, issued in PCT Application No. PCT/JP2012/082043 [with English Translation].

Office Action dated May 1, 2015, issued in U.S. Appl. No. 14/357,604.

European Search Report dated May 4, 2015, issued in European Application No. 12856806.0.

Office Action dated Aug. 4, 2015, issued in Chinese Application No. 201280056107.7 [with English Translation of part of Search Report].

Office Action dated May 18, 2016, issued in U.S. Appl. No. 14/357,604.

Extended European Search Report, dated Oct. 17, 2016, for counterpart European Application No. 14764532.9.

H-SECTION STEEL AND METHOD OF PRODUCING THE SAME

CROSS-REFERENCE TO RELATED APPLICATIONS

This application is a national stage application of International Application No. PCT/JP2014/056135, filed Mar. 10, 2014, which claims priority to Japanese Patent Application No. 2013-051954, filed on Mar. 14, 2013, each of which is herein incorporated by reference in its entirety.

TECHNICAL FIELD OF THE INVENTION

The present invention relates to a duplex stainless steel, and particularly to a duplex stainless steel having excellent localized corrosion resistance against pitting corrosion and crevice corrosion.

RELATED ART

For building structures, particularly, high-rise building structures, it is required that H-section steel having a thickness of 100 mm or more (hereinafter, referred to ultra thick H-section steel) is used. In general, as the strength of a steel material increases, or the thickness of a product increases, the toughness tends to deteriorate. Therefore, it is difficult to ensure the toughness of high strength thick steel.

In addition, H-section steel has a specific shape compared to a steel sheet. Although it is preferable that the H-section steel is produced by universal rolling, the rolling conditions (temperature and reduction) are limited in the universal rolling. Therefore, particularly, in the production of an ultra thick H-section steel, the temperature history and a reduction during rolling, and a cooling rate during accelerated cooling significantly vary depending on each portion of a web, flanges, and fillets. As a result, the strength and toughness significantly vary depending on the positions in the cross section of an ultra thick H-section steel produced by rolling.

Particularly, when ultra thick H-section steel is produced by applying hot rolling to steel pieces obtained through continuous casting, it is difficult to ensure the toughness through grain refinement. This is because it takes more time to roll an ultra thick H-section steel compared to a case of rolling a typical steel plate and particularly the temperature of the inside of the steel such as a filler portion at the time when rolling is finished is likely to become higher than the temperature of the surface.

Further, alloy elements are segregated at the thickness center portion of the steel piece obtained by continuous casting. The fillet portion of the H-section steel after rolling corresponds to a center segregation position of the steel piece. Therefore, a large number of mixtures of martensite and austenite (Martensite-Austenite Constituent, hereinafter, referred to as MA) or inclusions such as alumina are formed in the fillet portion and thus toughness is deteriorated.

In the related art, regarding the improvement of the toughness of an H-section steel, for example, in Patent Documents 1 to 3, there is proposed a method of producing a rolled section steel having high strength and excellent toughness through temperature controlled rolling and accelerated cooling in addition to fine dispersion of a Ti-based oxide and TiN. Further, for example, in Patent Document 4, there is proposed a method of producing a rolled section steel having excellent toughness by refining an austenite grain size through dispersion of a Ti-based oxide and TiN in the steel.

In addition, for example, in Patent Documents 5 to 7, there is proposed a method of improving toughness by refining the structure by pinning through dispersion of an oxide. Patent Document 5 discloses a technique of improving the toughness of an ultra thick H-section steel using fine oxides including Mg, and Patent Documents 6 and 7 disclose a technique of improving the toughness of an ultra thick H-section steel using a Ti oxide. Further, in Patent Documents 8 and 9, a method of improving the toughness of a steel plate which uses sulfides of Mg and Mn as pinning particles is proposed.

However, the technique in Patent Documents 1 to 4 is a technique using TiN. When TiN is healed at a high temperature during production, TiN is solid-soluted and thus TiN does not contribute to austenite grain size refinement and the toughness is not improved. In addition, the technique in Patent Documents 5 to 7 is a technique using oxides which are stable at a high temperature. However, it is not possible to make the pinning effect different in each portion of flanges, a web, and fillets and the pinning effect cannot be selectively increased at the fillets (toughness evaluation portions) in which the toughness is deteriorated.

The technique in Patent Documents 8 and 9 is a technique of improving the toughness of a high heat input heat affected zone of a steel plate. Since the thermal history is different for rolling and for welding, the technique in Patent Documents 8 and 9 do not directly contribute to improving the toughness of the rolled H-section steel.

PRIOR ART DOCUMENT

Patent Document

[Patent Document 1] Japanese Unexamined Patent Application, First Publication No. H5-263182

[Patent Document 2] Japanese Unexamined Patent Application, First Publication No. H10-147835

[Patent Document 3] Japanese Unexamined Patent Application, First Publication No. 2000-54060

[Patent Document 4] Japanese Unexamined Patent Application, First Publication No. 2001-3136

[Patent Document 5] Japanese Unexamined Patent Application, First Publication No. 2000-328174

[Patent Document 6] PCT International Publication No. WO2010/013358

[Patent Document 7] PCT International Publication No. WO2011/065479

[Patent Document 8] Japanese Unexamined Patent Application, First Publication No. 2002-3986

[Patent Document 9] Japanese Unexamined Patent Application, First Publication No. 2002-309338

DISCLOSURE OF THE INVENTION

Problems to be Solved by the Invention

In order to improve the strength of steel, it is effective to form a low temperature transformation structure such as bainite by finishing rolling before the temperature of the steel reaches a ferrite transformation start temperature ($Ar_3$ point) and subsequently starting water cooling. However, when an ultra thick H-section steel having a flange thickness of 100 mm or more is produced, a difference in temperature between the surface and the inside tends to be increased in the rolling process. As a result of an investigation by a computer simulation, the inventors have found that, for example, when an H-section steel having a flange thickness of 125 mm is produced, the difference in temperature between the surface and the inside reaches even 200° C.

Accordingly, when rolling of the ultra thick H-section steel is finished before the temperature of the steel surface reaches the ferrite transformation start temperature ($Ar_3$ point), the rolling finish temperature of the inside of the steel is 1100° C. or higher in some cases and thus there is a concern of causing coarsening of austenite grains. Therefore, for example, when a sample is taken from the inside separated from the surface in the ultra thick H-section steel similar to a toughness evaluation portion 8 shown in FIG. 1, the toughness may be significantly deteriorated.

When an ultra thick H-section steel is produced using continuous cast slabs, the center segregation of the slab is distributed on the ½ F line of FIG. 1 (at the center of FIG. 1 in the longitudinal direction). Therefore, the inventors have found that when the toughness of the toughness evaluation portion 8 shown in FIG. 1 is evaluated, a large amount of MA and inclusions (such as MnS) resulting from the segregation are formed and the toughness is further deteriorated.

The present invention has been made in consideration of such circumstances and an object thereof is to provide a high strength ultra thick H-section steel having excellent toughness and a method of producing the same. The H-section steel of the present invention is not a build-up H-section steel which is formed by welding steel sheets but a rolled or normalized H-section steel which is formed by hot rolling, particularly, universal rolling and does not require thermal refining such as quenching or tempering. The term "high strength" in the present invention refers to a strength of 550 MPa or more.

Means for Solving the Problem

In order to increase the toughness of steel, it is required that austenite grains are refined and hardenability is increased by containing an alloy element to suppress formation of intergranular ferrite so as to form a structure mainly composed of bainite.

The inventors have thought that in order to particularly ensure the toughness of the ultra thick H-section steel, particles which are thermally stable even at a high temperature are dispersed in the steel and austenite grains are refined during heating and rolling using a pinning effect at the grain boundaries by the particles. Specifically, detailed investigations on the type, size, (particle size), and density of particles required for refining the austenite grain size, and a preferable steel chemical composition in a hot rolling process have been repeatedly conducted.

As a result, the inventors have obtained findings that the austenite grains are refined by dispersing (Mg, Mn)S which is a fine sulfide including Mg and Mn in the steel in the hot rolling process of the ultra thick H-section steel, and the toughness increases. Further, the inventors have found that the amount of formed sulfides including Mg and Mn is significantly affected by the S content contained in the steel. That is, as the S content increases, the amount of sulfides including Mg and Mn increases and thus the austenite grains are further refined by the pinning effect.

In a portion in which center segregation occurs in a slabs (steel pieces) before production. S is concentrated by the segregation and sulfides including Mn and Mg are likely to be formed compared to a non-segregation portion. As a result, as long as an appropriate amount of the sulfides including Mn and Mg can be formed, finer austenite grains are formed in the segregation portion compared to the non-segregation portion and toughness deterioration due to alloy element concentration can be minimized. When the austenite grains are refined, the hardenability is deteriorated. However, in the present invention, the effect of refining the austenite grains by the sulfides including Mg and Mn is small in portions other than the segregation portion (non-segregation portions). Therefore, in portions other than the segregation portion, sufficient hardenability is ensured and thus the strength can be increased. That is, at a ½ position from the surface of the flange in the length direction and at a ¾ position from the surface of the flange in the thickness direction, corresponding to the segregation portion, the toughness can be ensured by setting the average grain size of prior austenite grains to 150 μm or less using the pinning effect by (Mg, Mn)S. On the other hand, at a ⅙ position from the surface of the flange in the length direction and at a ¼ position from the surface in the thickness direction, corresponding to the non-segregation portion, excessive refinement of prior austenite grains is suppressed and the area fraction of bainite becomes 80% or more and thus the strength can be ensured.

The inventors have found the above findings and completed the present invention.

The gist of the present invention is as follows.

(1) According to an aspect of the present invention, there is provided an H-section steel including, as a chemical composition, by mass %, C: 0.05% to 0.16%, Si: 0.01% to 0.50%, Mn: 0.80% to 2.00%, Ni: 0.05% to 0.50%, V: 0.01% to 0.20%, Al: 0.005% to 0.100%, Ti: 0.005% to 0.030%, N: 0.0010% to 0.0200%, S: 0.002% to 0.02%, Mg: 0.0005% to 0.005%, Cr: 0% to 0.50%, Cu: 0% to 0.50%, Mo: 0% to 0.20%. Nb: 0% to 0.05%. B: 0% to 0.0020%, and a remainder consisting of Fe and impurities, in which $C_{eq}$ obtained by the following Equation a is 0.35% to 0.50%, a thickness of a flange is 100 mm to 150 mm, an area fraction of bainite in a steel structure at a strength evaluation position which is at a ⅙ position from a surface of the flange in a length direction and at a ¼ position from the surface in a thickness direction is 80% or more, yield strength or 0.2% proof strength is 450 MPa or more and tensile strength is 550 MPa or more and 680 MPa or less at the strength evaluation position, an average austenite grain size in a steel structure at a toughness evaluation position which is at a ½ position from the surface of the flange in the length direction and at a ¾ position from the surface in the thickness direction is 150 μm or less, (Mg, Mn)S having a particle size of 0.005 μm to 0.5 μm is included at a density of $1.0\times10^5$ pieces/mm$^2$ to $1.0\times10^7$ pieces/mm$^2$, and the (Mg, Mn)S includes, by mass %, 20% to 80% of Mn, 20% to 80% of Mg and a remainder, and a ratio of S with respect to a total mass of S and O in the remainder is, by mass %, 50% to 100%.

$$C_{eq}=C+Mn/6+(Cr+Mo+V)/5+(Ni+Cu)/15 \quad \text{Equation a}$$

here, C, Mn, Cr, Mo, V, Ni, and Cu represent the amount of each element contained by mass % and the amount of an element not contained is 0.

(2) The H-section steel according to (1), may include, as the chemical composition, by mass %, one of or two or more of Cr: 0.01% to 0.50%. Cu: 0.01% to 0.50%, Mo: 0.001% to 0.20%, Nb: 0.001% to 0.05%, and B: 0.0001% to 0.0020%.

(3) According to another aspect of the present invention, there is provided a method of producing an H-section steel including forming (Mg, Mn)S by adding Mn, Mg, and Al to a molten steel and adjusting a chemical composition of the molten steel to include, by mass %, C: 0.05% to 0.16%, Si: 0.01% to 0.50%, Mn: 0.80% to 2.00%, Ni: 0.05% to 0.50%, V: 0.01% to 0.20%, Al: 0.005% to 0.100%, Ti: 0.005% to 0.030%, N: 0.0010% to 0.0200%, S: 0.002% to 0.02%, Mg: 0.0005% to 0.005%, Cr: 0% to 0.50%. Cu: 0% to 0.50%, Mo: 0% to 0.20%, Nb: 0% to 0.05%, B: 0% to 0.0020%, and a remainder consisting of Fe and impurities, and have $C_{eq}$ obtained by the following Equation b of 0.35% to 0.50%, casting the molten steel to obtain steel pieces, heating the steel piece to 1100° C. to 1350° C., performing a rough rolling on the heated steel pieces using a roughing mill and forming the steel pieces into an H-section steel, performing a reverse rolling on the H-section steel using an intermediate rolling mill, performing a finish rolling on the H-section steel using a finishing mill so that a rolling finish temperature reaches a surface temperature of 800° C. or higher, water-cooling the H-section steel, and recuperating a temperature of the H-section steel so that the surface temperature is within a temperature range of 300° C. to 700° C., in which in the forming of the (Mg, Mn)S, the concentration of O in the molten steel when the Mg is added is 50 ppm or less, and the reverse rolling in the performing of the reverse rolling is controlled rolling.

$$C_{eq}=C+Mn/6+(Cr+Mo+V)/5+(Ni+Cu)/15 \quad \text{Equation b}$$

here, C, Mn, Cr, Mo, V, Ni, and Cu represent the amount of each element contained by mass % and the amount of an element not contained is 0.

(4) The method of producing an H-section steel according to (3), the steel may contain, as the chemical composition, by mass %, one of or two or more of Cr: 0.01% to 0.50%, Cu: 0.01% to 0.50%. Mo: 0.001% to 0.20%, Nb: 0.001% to 0.05%, and B: 0.0001% to 0.0020%.

Effects of the Invention

According to the above aspects of the present invention, it is possible to obtain a high strength ultra thick H-section steel having a flange thickness of 100 mm to 150 mm, a yield strength or 0.2% proof strength of 450 MPa or more, and a tensile strength of 550 MPa or more. The high strength ultra thick H-section steel according to the present invention can be produced without adding a large amount of alloys or reducing carbon to the ultra low carbon level, which causes significant steel-making loads. Accordingly, this makes it possible to reduce production costs and shorten production time, thereby achieving a significant reduction in costs. That is, according to the above aspects of the present invention, the reliability of large buildings can be improved without sacrificing cost efficiency, and hence, the present invention makes an extremely significant contribution to industries.

EMBODIMENTS OF THE INVENTION

Figure 1:
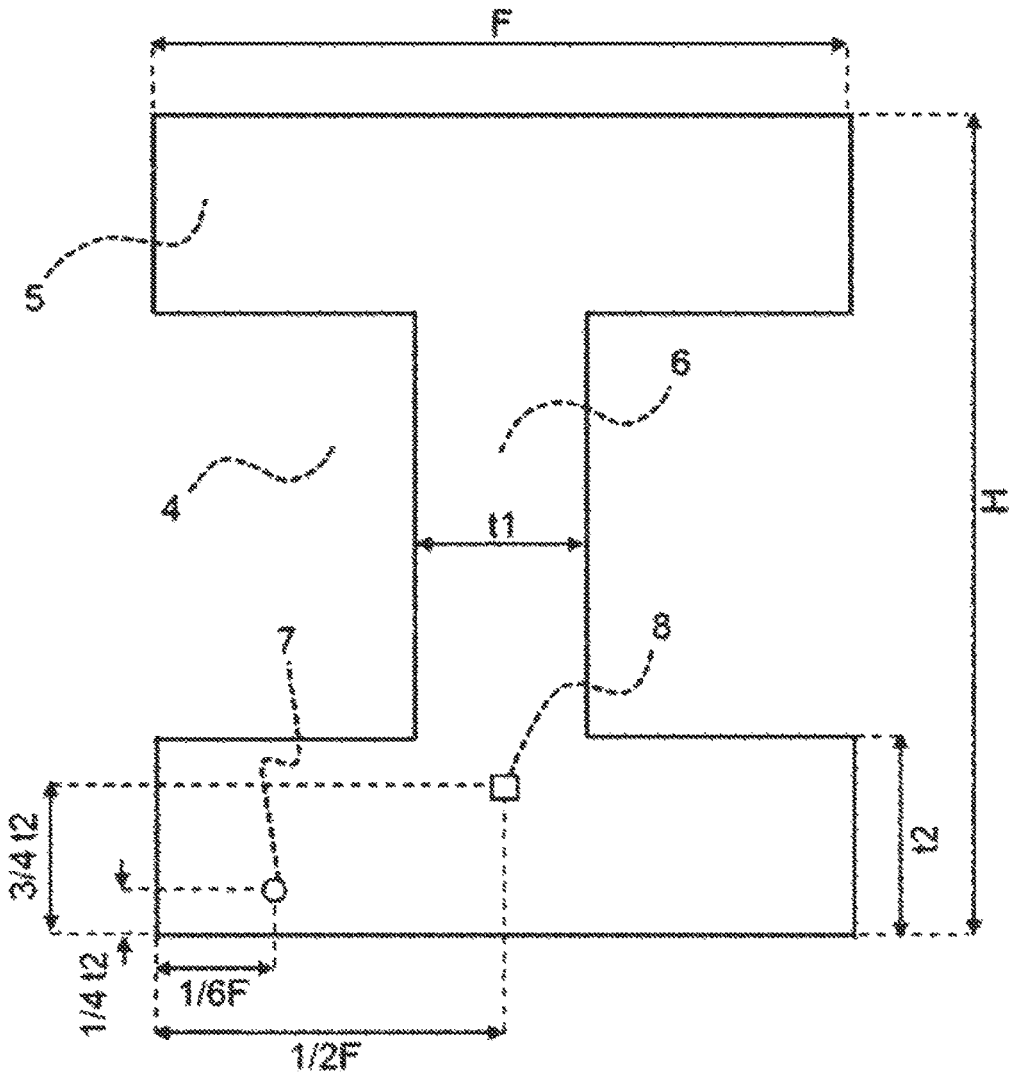
FIG. 1 is a view illustrating a cross-sectional shape of an H-section steel.

Hereinafter, an H-section steel according to an embodiment of the present invention (hereinafter, sometimes referred to as an H-section steel according to an embodiment) and a method of producing the same will be described. The amount of S at a ½ position from the surface of a flange of the H-section steel in the length direction and at a ¾ position from the surface of a flange of the H-section steel in the thickness direction, corresponding to a segregation portion of a steel piece is larger than at other portions. In the H-section steel according to the embodiment, by the addition of Mg and Mn, (Mg, Mn)S having a grain size of 0.005 μm to 0.5 μm is finely dispersed in a range of $1.0\times10^5$ pieces/mm$^2$ to $1.0\times10^7$ pieces/mm$^2$ in the steel. Therefore, even in the ultra thick H-section steel having a flange thickness of 100 mm to 150 mm, good toughness can be obtained.

The number of (Mg, Mn)S particles may be measured using a transmission electron microscope (TEM) by sampling an extraction replica from the steel. Specifically, the number density of the particles may be calculated by observing an area of 10000 μm$^2$ or more with a TEM and measuring the number of particles having a particle size (equivalent circle diameter) of 0.005 μm to 0.5 μm. However, since there are large number of particles, it is very difficult to confirm whether or not individual precipitates are (Mg, Mn)S with respect to the entirety of the particles. Here, in the embodiment, the component analysis of at least 50 particles among the measured particles is performed using an energy dispersive X-ray analyzer (EDX) to calculate the ratio of (Mg, Mn)S among the precipitate particles. Then, the product of the ratio and the number density is obtained to derive the number density of (Mg, Mn)S.

(Mg, Mn)S is a precipitate including Mn, Mg, and S. However, in the embodiment, a precipitate in which the amounts of Mn and Mg are respectively 20%≤Mn≤80%, and 20%≤Mg≤80% by mass % in the composition ratio thereof, and the ratio of S in the balance other than Mn and Mg with respect to a total S content and O is S≥50% by mass % is defined as (Mg, Mn)S by performing the analysis using the EDX. Since O is not necessarily contained in (Mg, Mn)S, the upper limit of the ratio of S is 100%.

Next the reason for limiting the component range (chemical composition) of the H-section steel according to the embodiment will be described. Here, the symbol "%" of the components indicates mass %. The chemical components described below have analysis values in the molten steel and this value may be considered as an average value in the entire steel.

(C: 0.05% to 0.16%)

C is an element effective in strengthening the steel, and the lower limit value of the C content is set to 0.05%. The lower limit of the C content is preferably 0.08%. On the other hand, when the C content is more than 0.16%, carbides are formed and toughness is deteriorated. Therefore, the upper limit of the C content is set to 0.16%. In order to further improve the toughness, the upper limit of the C content is preferably set to 0.12%.

(Si: 0.01% to 0.50%)

Si is a deoxidizing element and contributes to improving strength. In order to obtain these effects, the lower limit of the amount Si is set to 0.01%. On the other hand, when the Si content is excessive, formation of MA is promoted and toughness is deteriorated. Therefore, the upper limit of the Si content is set to 0.50%. In order to further improve the toughness, the upper limit of the Si content is preferably 0.30% and more preferably 0.20%.

(Mn: 0.80% to 2.00%)

Mn is an element necessary for formation of (Mg, Mn)S and thus the lower limit of the Mn content is set to 0.80%.

Mn is an element which increases hardenability and the lower limit of the Mn content is preferably set to 1.00% in order to improve strength. However, when the Mn content is more than 2.00%, (Mg, Mn)S is coarsened and Mn serves as a brittle fracture origin and toughness is deteriorated. Therefore, the upper limit of the Mn content is set to 2.00%.

(Ni: 0.05% to 0.50%)

Ni is a significantly effective element for increasing the strength and toughness of the steel. In order to obtain these effects, the lower limit of the Ni content is set to 0.05%. Particularly, in order to increase the toughness, the lower limit of the Ni content is preferably set to 0.10%. On the other hand, when the Ni content is more than 0.50%, alloying costs are increased. Thus, the upper limit of the Ni content is set to 0.50%. The upper limit of the Ni content is preferably 0.30%.

(V: 0.01% to 0.20%)

V contributes to improving hardenability, further forms carbonitrides, and contributes to grain refining and precipitation strengthening. In order to obtain these effects, the lower limit of the V content is set to 0.01%. The lower limit of the V content is preferably 0.05%. However, when the V content is excessive, precipitates are coarsened, possibly leading to a deterioration in toughness. Therefore, the upper limit of the V content is set to 0.20%. The upper limit of the V content is preferably 0.08%.

(Al: 0.005% to 0.100%)

Al is an element necessary for forming sulfides by suppressing precipitation of Mg in the molten steel as an oxide, and thus, the lower limit of the Al content is set to 0.005%. However, when the Al content is excessive, Al oxides are coarsened and toughness is deteriorated. Therefore, the upper limit of the Al content is set to 0.100%. The upper limit of the Al content preferably is 0.060% and more preferably 0.040%.

(Ti: 0.005% to 0.030%)

Ti is an element effective in improving toughness by improving strength and grain refining. In order to obtain these effects, the lower limit of the Ti content is set to 0.005%. However, when the Ti content is more than 0.030%, coarse TiN is formed and toughness is deteriorated. Thus, the upper limit of the Ti content is set to 0.030%. In order to suppress a deterioration in toughness due to formation of coarse TiC precipitates, the upper limit of the Ti content is preferably 0.020%.

(N: 0.0010% to 0.0200%)

N is an important element to form TiN and VN and is an element contributing to grain refining and precipitation strengthening. In order to obtain these effects, the N content is set to 0.0010%. However, when the N content is excessive, the toughness of a base metal is deteriorated and thus the upper limit of the N content is set to 0.0200%. The upper limit of the N content is preferably 0.0100%.

(S: 0.002% to 0.02%)

S is an element necessary for forming (Mg, Mn)S. In order to sufficiently precipitate (Mg, Mn)S, the lower limit of the S content is set to 0.002%. In order to distribute a larger amount of (Mg, Mn)S, the lower limit of the S content is preferably 0.004%. On the other hand, when the S content is more than 0.02%, coarse (Mg, Mn)S is formed and toughness is deteriorated. Thus, the upper limit of the S content is set to 0.02%.

(Mg: 0.0005% to 0.005%)

Mg is an element necessary for forming (Mg, Mn)S and thus the lower limit of the Mg content is set to 0.0005%. In order to obtain a larger amount of (Mg, Mn)S, the lower limit of the Mg content is preferably set to 0.0010%. On the other hand, when the Mg content is more than 0.005%, (Mg, Mn)S is coarsened and cost efficiency is deteriorated. Therefore, the upper limit of the Mg content is set to 0.005%.

(P: 0.03% or Less)

P is contained as an impurity and cause a deterioration in toughness and weld cracking occurring as a result of solidifying segregation. Thus, it is preferable to reduce the P content. The P content is preferably limited to 0.03% or less and more preferably limited to 0.01% or less.

The H-section steel according to the embodiment basically contains the above-described elements. However, the steel may include elements other than the above-described elements as impurities within a range not deteriorating the characteristics. The impurities indicate those impurities that are mixed from raw materials such as ore and scrap or production environments.

Further, in order to increase strength by improving hardenability, the steel may contain one of or two or more of Cr, Cu, Mo. Nb, and B within the following ranges. Cr, Cu, Mo, Nb, and B are optional elements and not necessarily contained in the steel. Therefore, all of the lower limits of these elements are 0%.

(Cr: 0.50% or Less)

Cr is an element contributing to improving the strength of the steel by improving hardenability. In order to improve the hardenability, the lower limit of the Cr content is preferably set to 0.01% and the lower limit of the Cr content is more preferably set to 0.10%. On the other hand, when the C content is more than 0.50%, formation of MA is promoted and Cr carbides are coarsened, possibly deteriorating the toughness of the steel. Therefore, the upper limit of the Cr content is preferably limited to 0.50%. The upper limit of the Cr content is more preferably 0.30%.

(Cu: 0.50% or Less)

Cu is an element contributing to improving the strength of the steel by hardenability improvement and precipitation strengthening. In order to obtain these effects, the lower limit of the Cu content is preferably set to 0.01%. The lower limit of the Cu content is more preferably 0.10%. However, when the Cu content is excessive, formation of Ma is promoted, possibly deteriorating toughness. Accordingly, the upper limit of the Cu content is preferably set to 0.50%. The upper limit of the Cu content is more preferably 0.30% and still more preferably 0.20%.

(Mo: 0.20% or Less)

Mo is an element contributing to improving the strength of the steel by improving hardenability. Particularly, when the steel also contains B, the synergy effect of B and Mo related to hardenability improvement is significant. In the case in which the above-described effect is obtained, the lower limit of the Mo content is preferably set to 0.001%. The lower limit of the Mo content is more preferably 0.01% and still more preferably 0.03%. However, when the Mo content is more than 0.20%, formation of MA is promoted, possibly deteriorating toughness. Therefore, the upper limit of the Mo content is preferably set to 0.20%. In order to prevent a deterioration in toughness, the upper limit of the Mo content is more preferably 0.10%.

(Nb: 0.05% or Less)

Nb is an element that increases hardenability like Mo and when Nb and B are contained in a combined manner, it is possible to obtain a significant effect of increasing the hardenability even with a small amount. In order to obtain such an effect, the lower limit of the Nb content is preferably set to 0.001%. The lower limit of the Nb content is more preferably 0.005% and still more preferably 0.010%. However, when the Nb content is excessive, toughness may be deteriorated and thus the upper limit of the Nb content is preferably set to 0.05%. The upper limit of the Nb content is more preferably 0.03%.

(B: 0.0020% or Less)

B is an element effective in improving the strength and toughness of the steel by increasing hardenability with very small amount of addition and suppressing ferrite transformation from austenite grain boundaries. In order to obtain these effects, the lower limit of the B content is preferably set to 0.0001%. The lower limit of the B content is more preferably 0.0003% and still more preferably 0.0005%. On the other hand, when the B content is more than 0.0020%, a large amount of MA is formed, possibly significantly deteriorating toughness. Therefore, the upper limit of the B content is preferably set to 0.0020%.

O is an impurity and the amount thereof is not limited in the embodiment. However, in order to avoid a state in which Mg forms oxides and does not form sulfides when steel is melted, it is important to deoxidize sufficiently by the addition of Al.

In the embodiment, in order to increase hardenability to form bainite, the carbon equivalent $C_{eq}$ expressed by the following Equation (1) is set to 0.35% to 0.50%. When the $C_{eq}$ is less than 0.35%, bainite is not sufficiently formed, which results in a deterioration in the strength and toughness of the steel. The lower limit of the $C_{eq}$ is preferably 0.38% and more preferably 0.40%. On the other hand, when the $C_{eq}$ is more than 0.50%, the strength is excessively increased and the toughness is deteriorated. The upper limit of the $C_{eq}$ is preferably 0.45% and more preferably 0.43%.

The carbon equivalent $C_{eq}$ is an index of hardenability and is obtained by the following Equation (I). Here, C, Mn, Cr, Mo, V, Ni, and Cu represent the amount of the elements contained. The amount of the elements which are not contained is set to 0.

$$C_{eq}=C+Mn/6+(Cr+Mo+V)/5+(Ni+Cu)/15 \quad \text{Equation (1)}$$

When the steel having the above chemical composition is subjected to hot rolling and then accelerated cooling by water cooling, which will be described later, to produce an ultra thick H-section steel, formation of ferrite is suppressed. As a result, the area fraction of bainite is 80% or more and thus it is possible to ensure the strength without deteriorating the toughness.

Next, the microstructure of the H-section steel according to the embodiment will be described.

In the case of an ultra thick H-section steel, the rolling finishing temperature near the surface is low and the cooling rate during water cooling is high. Thus, the steel structure (microstructure) is fine. On the other hand, the rolling finishing temperature of the inside is higher than the temperature near the surface and the cooling rate during water cooling is low. Thus, the austenite grains are coarsened and the toughness is deteriorated.

FIG. 1 is a view showing a cross-sectional shape of an H-section steel. An H-section steel 4 includes a flange 5 and a web 6. In FIG. 1, the entire length of the flange is represented by F, the height is represented by H, the thickness of the web is represented by $t_1$, and the thickness of the flange is represented by $t_2$. Then, the reference number 7 represents a strength evaluation portion and the reference number 8 represents a toughness evaluation portion. The strength evaluation portion 7 shown in FIG. 1 is a portion that is at a ⅙ position from the surface of the flange in the length direction and at a ¼ position from the surface of the flange in the thickness direction and can be considered to obtain an average structure in the embodiment. A sample for evaluation of strength was taken from this portion and the observation of the microstructure and the measurement of the area fraction of bainite were performed. The metallographic structure can be determined by observation with an optical microscope. The area fraction of the microstructure can be calculated as a ratio of the number of grains in each structure by arranging measurement points in a lattice shape in which one side is 50 μm and distinguishing the structures with 400 measurement points using a structure image photographed at a magnification of 200 times using an optical microscope.

Bainite contributes to increasing strength and grain refining. In order to ensure the strength, it is necessary that the steel structure includes bainite with an area fraction of 80% or more at the strength evaluation portion 7 in FIG. 1. The remainder includes one of or two or more of ferrite, pearlite, and island-shaped martensite (MA). Since an increase in the area fraction of bainite contributes to improving the strength, the upper limit of the area fraction of bainite is not defined and may be 100%.

In addition, in the embodiment, since the rolling finishing temperature in a portion near the thickness center such as the fillet portion is high, the austenite grains are coarsened, and since the cooling rate during water cooling is low, intergranular ferrite is likely to be coarsened. Further, the segregation derived from the center segregation in a slab is present as described above. Therefore, particularly, the toughness evaluation portion 8 shown in FIG. 1 has the lowest toughness. The position of the toughness evaluation portion 8 is at a ½ position from the surface of the flange in the length direction and at a ¾ position from the surface in the thickness direction. A sample is taken from the portion having the lowest toughness to evaluate the toughness and the microstructure at the same portion is observed to identify inclusions and evaluate the average grain size of the austenite grains (average austenite grain size). The austenite grain size is a so-called prior austenite grain size before low temperature transformation by cooling after hot rolling, and is measured using a structure image obtained using an optical microscope at a magnification of 50 times or an EBSP observation image measured at a magnification of 70 times.

The inventors have found that it is necessary to control the austenite grain size (prior austenite grain size) to 150 μm or less in the toughness evaluation portion 8 to increase the toughness under the presence of segregation. In order to improve the toughness, as the austenite grain size decreases, it is more preferable. However, when the austenite grain size is refined, the hardenability is deteriorated and there is a concern that the strength of the H-section steel may be deteriorated. Therefore, the lower limit of the austenite grain size is preferably set to 50 μm. The inventors have conducted an investigation on the type and number density of precipitates for pinning the austenite grains, which are necessary for realizing grain refinement, particularly in a portion in which segregation is present (segregation portion).

It is apparent that many elements such as Mn, P, S, Ni, and Cu are concentrated in the segregation portion. However, among these elements, the inventors have focused on the concentration of S. The inventors have found that in steel obtained by using (Mg, Mn)S which is a complex sulfide of Mg and Mn, when the S content in the steel is increased, the amount of (Mg, Mn)S precipitated is increased and thus the austenite grains are reliably refined in the segregation portion.

The inventors have conducted an investigation on (Mg, Mn)S being used at the toughness evaluation portion that is typically considered as a portion having the lowest toughness in the ultra thick H-section steel. As a result, the austenite grains can be refined by increasing the amount of (Mg, Mn)S by utilizing characteristics that S is concentrated due to the segregation of the slab in the toughness evaluation portion.

The inventors have found when the steel structure includes (Mg, Mn)S having a grain size of 0.005 μm to 0.5 μm at a density of $1.0\times10^5$ pieces/mm$^2$ to $1.0\times10^7$ pieces/mm$^2$, the austenite grain size is reduced to 150 μm or less due to recrystallization effect by pinning effect and rolling and thus the toughness is improved. The steel pieces are retained at a high temperature for a longer period of time in heating performed before rolling of steel pieces than in welding. In the embodiment, it is assumed that the maximum temperature is set to 1350° C. and the heating time is set to 5 hour at most as the heating conditions before rolling. The inventors have confirmed that even when the steel pieces are heated under such conditions, the precipitation density of (Mg, Mn)S is not lowered and the pinning effect of the austenite grains is not lost. In addition, it is confirmed that as long as the size of such sulfide particles is 0.5 μm or less, the sulfides do not functions as the brittle fracture origin in the ultra thick H-section steel. Therefore, the upper limit of the particle size of (Mg, Mn)S is set to 0.5 μm. Even when the particle size is small, no problem arises. However, since the extraction replica is used for the measurement, the observation is not easy when the size is less than 0.005 μm. Thus, from the viewpoint of measurement accuracy and quantitativity, the size for counting the number of particles is preferably 0.005 μm or more.

When the number density of the particles is less than $1.0\times10^5$ pieces/mm$^2$, a sufficient pinning effect cannot be obtained. On the other hand, when the number density of the particles is more than $1.0\times10^7$ pieces/mm$^2$, the austenite grains are excessively refined and the hardenability is deteriorated, possibly deteriorating the strength, which is not preferable.

The thickness of the flange of the H-section steel according to the embodiment is set to 100 mm to 150 mm. The reason for limiting the lower limit to 100 mm is that for example, a strength member having a thickness of 100 mm or more is required as an H-section steel used for high-rise building structures. On the other hand, when the thickness of the flange is more than 150 mm, a sufficient cooling rate cannot be obtained and it is difficult to ensure the toughness. Thus, the upper limit is set to 150 mm. Although the thickness of the web of the H-section steel is not particularly defined, the thickness is preferably 50 mm to 150 mm.

The thickness ratio between the flange and the web (thickness ratio expressed by flange/web) is preferably set to 0.5 to 2.0 on the assumption that the H-section steel is produced by hot rolling. When the thickness ratio between the flange and the web is more than 2.0, the web may be deformed into a wavy shape. On the other hand, when the thickness ratio between the flange and the web is less than 0.5, the flange may be deformed into a wavy shape.

For the mechanical characteristics, the target values are set as follows: the yield strength or 0.2% proof strength at normal temperatures is set to 450 MPa or more, and the tensile strength is set to 550 MPa or more. Further, the Charpy absorbing energy at 21° C. is set to 100 J or more. The excessively high strength possibly causes a deterioration in toughness. Thus, it is preferable to set the yield strength or 0.2% proof strength at normal temperatures to 500 MPa or less, and set the tensile strength to 680 MPa or less.

Next, a preferred method of producing the H-section steel according to this embodiment will be described.

In the embodiment, (Mg, Mn)S is formed by, for example, setting the temperature of the molten steel to 1650° C. or less, setting the oxygen concentration in the molten steel to 0.01% or less, setting the concentration of S in the molten steel to 0.02% or less, and adding appropriate amounts of Mn. Mg, and Al (refining process: S1). However, at this time, in order to prevent the Mg content for forming (Mg, Mn)S from being insufficient due to combination of Mg with oxygen (O) to form an oxide, it is necessary to set the concentration of oxygen in the molten steel when Mg is added to 50 ppm or less. Therefore, when the concentration of oxygen in the molten steel is not less than 50 ppm, it is necessary that Al is added before Mg is added and the oxygen in the molten steel is consumed in the form of Al oxide.

In addition, in the refining process, the chemical composition is adjusted so as to fall within the above-described preferable range.

After the chemical composition of the molten steel is adjusted, the steel is cast to obtain steel pieces (casting process: S2). As for the casting, from the viewpoint of productivity, continuous casting is preferable. However, the steel may be casted to a beam blank having a shape close to the shape of an II-section steel to be produced. Further, the thickness of the steel piece is preferably 200 mm or more from the viewpoint of productivity and preferably 350 mm or less in consideration of segregation reduction and heating temperature uniformity in hot rolling.

Next, the steel pieces are heated (heating process: S3). The lower limit of the heating temperature of the steel piece is set to 1100° C. to sufficiently solid-solute elements, such as Ti and Nb, for forming carbides and nitrides. On the other hand, when the heating temperature is higher than 1350° C., scale on the surface of the steel piece, which is a raw material, is liquefied and causes difficulties. Thus, the upper limit of the heating temperature is set to 1350° C.

After the heating process, a hot rolling process is performed (hot rolling process: S4). The hot rolling includes a rough rolling process (S41) of performing rough rolling using a roughing mill, an intermediate rolling process (S42) of performing intermediate rolling (reverse rolling) using an intermediate rolling mill, and a finish rolling process (S43) of performing finish rolling using a finishing mill. The steel pieces are formed into a substantially H shape by rough rolling and undergo intermediate rolling and finish rolling to obtain an H-section steel having a predetermined target shape.

In the hot rolling, it is preferable that rolling is performed by controlling the rolling temperature and the reduction. This is because the austenite grain size may be further refined by recrystallization during rolling. Particularly, in the intermediate rolling process, reverse rolling is performed and this reverse rolling is performed as controlled rolling in which the rolling temperature and the reduction are controlled. As the controlled rolling, for example, the H-section steel may be rolled while being cooled using water cooling devices provided on the front and rear surfaces of the intermediate rolling mill.

It is preferable that the austenite grains are refined to ensure toughness. On the other hand, it is preferable that the size of austenite grains is increased to increase hardenability in order to ensure strength. Accordingly, it is desired that the rolling temperature is lowered to ensure toughness and the rolling temperature is increased to ensure strength.

However, in the H-section steel according to the embodiment, as described above, the austenite grain size in the segregation portion is made finer by (Mg, Mn)S than in a non-segregation portion, and thus, it is preferable that a rolling temperature of 800° C. or higher is ensured as a surface temperature. Therefore, in the production of the H-section steel according to the embodiment, rolling is finished at a surface temperature of 800° C. or higher. When the rolling finish temperature is lower than 800° C., the austenite grain size of the strength evaluation portion is excessively refined and the hardenability is deteriorated and the strength is decreased, which is not preferable. It can be thought that the thermal stability of the precipitates of (Mg, Mn)S is high and there are almost no changes in the pinning effect due to variations in the rolling process. Therefore, from the viewpoint of ensuring strength, it is preferable that the steel having high hardenability is rolled at a low temperature and the steel having low hardenability is rolled at a high temperature. It is preferable that the temperature is appropriately controlled according to the chemical composition of the steel.

A process of performing primary rolling on steel, cooling the steel to 500° C. or lower, then reheating the steel to 1100° C. to 1350° C. and performing secondary rolling on the steel, that is, so-called two-heat rolling may be employed. With the two-heat rolling, there is little plastic deformation in the hot rolling and the drop in temperature in the rolling process also becomes smaller, and thus, the heating temperature in the second heating rolling can be lowered.

In addition, in the case of lowering the rolling temperature, it is effective to perform water cooling rolling between rolling passes for one or more passes in the finish rolling. The interpasswater cooling rolling is a method in which the surface temperature of the flange is cooled to 700° C. or lower and then rolling is performed in the recuperating process. The interpasswater cooling rolling is a method of rolling in which, by performing water cooling between passes, difference in temperature between the surface portion of the flange and the inside of the flange is imparted. During interpasswater cooling rolling, it is possible to introduce work strain into the inside of the steel in the thickness direction even when the reduction is small. Further, by lowering the rolling temperatures within a short period of time through water cooling, the productivity can be improved.

After the finish rolling, in order to obtain high strength, the flange and the web are water-cooled (cooling process: S5). The water cooling can be performed by water spray with a spray or water immersion cooling in a water tank. In the embodiment, it is preferable to perform water cooling such that a cooling rate from 800° C. to 500° C. is 2.2° C./s or more at the position of the strength evaluation portion 7 of FIG. 1. When the cooling rate is less than 2.2° C./s, there is a possibility that the desired hardened structure cannot be obtained. The higher the cooling rate is, the more preferable it is. Thus, it is not necessary that the upper limit is not particularly set.

After the cooling process, recuperating the temperature of the steel is performed such that the surface temperature after the water cooling is stopped is within a temperature range of 300° C. to 700° C. (recuperating process: S6). In order to recuperate the temperature of the steel to the above temperature range, it is effective to stop water cooling under the condition that recuperating is performed until the surface temperature after the water cooling is stopped reaches a temperature of 300° C. to 700° C. when the water cooling is performed. When the temperature after the recuperating (recuperated temperature) is lower than 300° C., self annealing is not sufficient and the strength is increased and the toughness is deteriorated. Further, when the recuperated temperature is higher than 700° C., hardening is not sufficient at the thickness center and ferrite formed from the prior austenite grain boundaries is significantly coarsened to cause a deterioration in toughness or the annealing temperature is excessively increased even near the thickness surface to cause a deterioration in toughness in some cases.

For the water cooling condition, it is preferable to control not the water cooling stop temperature but the above-described recuperated temperature to a predetermined temperature range. This is because a difference in cooling rate between the surface and the inside of the ultra thick H-section steel is large and the inside temperature is affected by the water cooling time. That is, the surface temperature can be cooled to 200° C. or lower in a short period of time after the cooling is started. However, the inside cooling rate is low and thus the inside temperature is controlled by the water cooling time to manage the thermal history in the recuperated temperature. As long as the relationship between the cooling rate, and the cooling time and the recuperated temperature is measured in advance, the recuperated temperature of the ultra thick H-section steel can be controlled by the cooling time.

Figure 2:
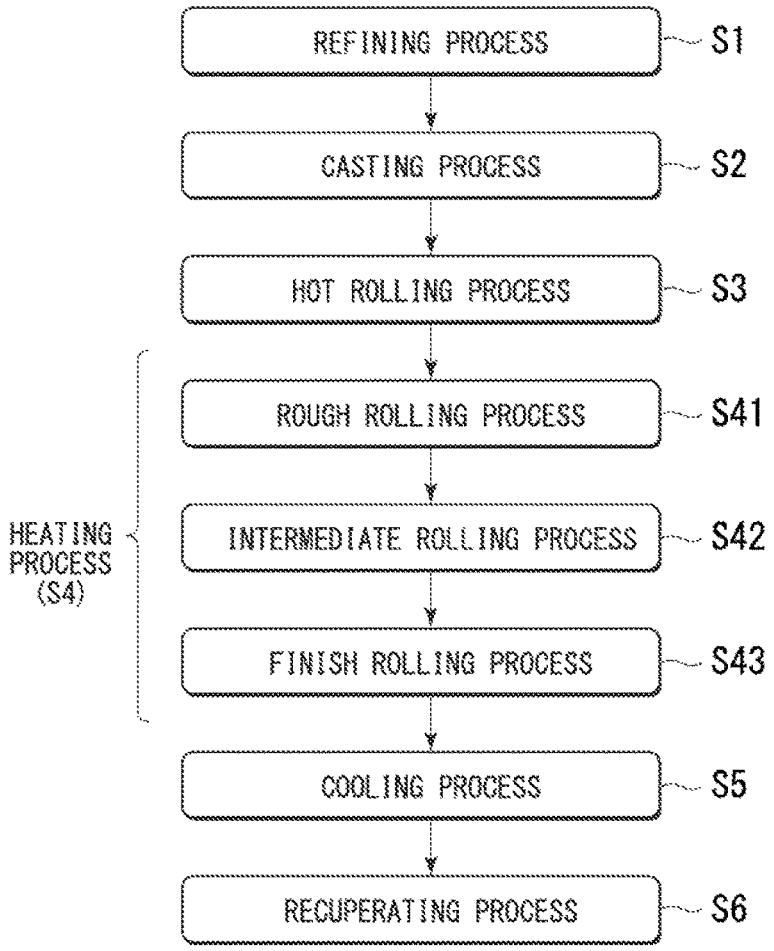
FIG. 2 is a diagram illustrating an example of a process of producing an H-section steel according to an embodiment.

An example of the flow chart of the above-described production process is shown in FIG. 2.

EXAMPLES

The steel having the chemical composition shown in Table 1 was melted to produce steel pieces having a thickness of 240 mm to 300 mm by continuous casting. The steel was melted in a converter and primary deoxidation was performed. Alloys were added to adjust the components and vacuum degassing treatment was performed as required. The steel pieces thus obtained were subjected to heating, hot rolling, cooling and recuperating, thereby producing an H-section steel. The components shown in Table 1 were results obtained by measuring samples taken from the molten steel. Further, the remainder of the components shown in Table 1 includes Fe and impurities.

TABLE 1

| COMPONENT | CHEMICAL COMPONENT [mass %] | | | | | | | | | |
|---|---|---|---|---|---|---|---|---|---|---|
| NO. | C | Si | Mn | P | S | Ni | V | Al | Ti | N |
| 1 | 0.159 | 0.03 | 0.83 | 0.010 | 0.0050 | 0.45 | 0.121 | 0.021 | 0.020 | 0.0055 |
| 2 | 0.155 | 0.09 | 1.25 | 0.005 | 0.0105 | 0.08 | 0.035 | 0.018 | 0.016 | 0.0017 |
| 3 | 0.131 | 0.15 | 1.30 | 0.007 | 0.0180 | 0.12 | 0.050 | 0.009 | 0.012 | 0.0103 |
| 4 | 0.130 | 0.30 | 1.41 | 0.029 | 0.0098 | 0.06 | 0.032 | 0.006 | 0.005 | 0.0080 |
| 5 | 0.120 | 0.28 | 1.52 | 0.020 | 0.0080 | 0.10 | 0.054 | 0.030 | 0.011 | 0.0029 |
| 6 | 0.119 | 0.10 | 1.55 | 0.020 | 0.0069 | 0.10 | 0.059 | 0.031 | 0.015 | 0.0042 |
| 7 | 0.110 | 0.12 | 1.54 | 0.021 | 0.0073 | 0.20 | 0.055 | 0.029 | 0.014 | 0.0037 |

TABLE 1-continued

| | | | | | | | | | | |
|---|---|---|---|---|---|---|---|---|---|---|
| 8 | 0.110 | 0.36 | 1.40 | 0.009 | 0.0040 | 0.42 | 0.049 | 0.053 | 0.010 | 0.0040 |
| 9 | 0.101 | 0.21 | 1.10 | 0.014 | 0.0029 | 0.44 | 0.011 | 0.080 | 0.007 | 0.0021 |
| 10 | 0.102 | 0.40 | 1.31 | 0.011 | 0.0025 | 0.33 | 0.023 | 0.094 | 0.027 | 0.0160 |
| 11 | 0.090 | 0.47 | 1.73 | 0.012 | 0.0087 | 0.22 | 0.050 | 0.032 | 0.019 | 0.0070 |
| 12 | 0.088 | 0.31 | 1.50 | 0.009 | 0.0103 | 0.18 | 0.081 | 0.030 | 0.016 | 0.0054 |
| 13 | 0.079 | 0.20 | 1.87 | 0.007 | 0.0123 | 0.21 | 0.105 | 0.027 | 0.014 | 0.0044 |
| 14 | 0.079 | 0.09 | 1.78 | 0.006 | 0.0091 | 0.19 | 0.120 | 0.030 | 0.015 | 0.0029 |
| 15 | 0.070 | 0.08 | 1.50 | 0.004 | 0.0074 | 0.20 | 0.092 | 0.031 | 0.012 | 0.0033 |
| 16 | 0.059 | 0.07 | 1.91 | 0.015 | 0.0082 | 0.10 | 0.131 | 0.025 | 0.009 | 0.0121 |
| 17 | 0.050 | 0.08 | 1.42 | 0.017 | 0.0076 | 0.09 | 0.072 | 0.029 | 0.010 | 0.0031 |
| 18 | 0.190 | 0.29 | 1.55 | 0.020 | 0.0066 | 0.15 | 0.048 | 0.032 | 0.012 | 0.0028 |
| 19 | 0.021 | 0.31 | 1.53 | 0.021 | 0.0049 | 0.24 | 0.050 | 0.021 | 0.011 | 0.0029 |
| 20 | 0.115 | 0.80 | 1.51 | 0.029 | 0.0040 | 0.20 | 0.055 | 0.040 | 0.019 | 0.0044 |
| 21 | 0.110 | 0.39 | 2.02 | 0.009 | 0.0050 | 0.09 | 0.058 | 0.033 | 0.016 | 0.0030 |
| 22 | 0.098 | 0.28 | 1.55 | 0.011 | 0.0071 | 0.09 | 0.063 | 0.002 | 0.012 | 0.0053 |
| 23 | 0.097 | 0.28 | 1.55 | 0.020 | 0.0083 | 0.18 | 0.056 | 0.027 | 0.035 | 0.0028 |
| 24 | 0.103 | 0.24 | 1.51 | 0.011 | 0.0066 | 0.10 | 0.049 | 0.039 | 0.010 | 0.0220 |
| 25 | 0.120 | 0.09 | 1.47 | 0.007 | 0.0014 | 0.09 | 0.055 | 0.029 | 0.009 | 0.0095 |
| 26 | 0.122 | 0.08 | 1.45 | 0.007 | 0.0034 | 0.11 | 0.053 | 0.032 | 0.008 | 0.0051 |
| 27 | 0.080 | 0.12 | 1.20 | 0.021 | 0.0070 | 0.05 | 0.020 | 0.029 | 0.011 | 0.0027 |
| 28 | 0.151 | 0.38 | 1.75 | 0.020 | 0.0069 | 0.35 | 0.058 | 0.027 | 0.011 | 0.0029 |
| 29 | 0.150 | 0.30 | 0.57 | 0.020 | 0.0050 | 0.35 | 0.049 | 0.029 | 0.012 | 0.0030 |
| 30 | 0.121 | 0.29 | 1.49 | 0.025 | 0.0272 | 0.20 | 0.056 | 0.031 | 0.011 | 0.0027 |
| 31 | 0.118 | 0.24 | 1.54 | 0.017 | 0.0101 | 0.19 | 0.057 | 0.139 | 0.010 | 0.0029 |
| 32 | 0.110 | 0.28 | 1.53 | 0.015 | 0.0068 | 0.15 | 0.059 | 0.033 | 0.012 | 0.0037 |

| COMPONENT | CHEMICAL COMPONENT [mass %] | | | | | | Ceq | |
|---|---|---|---|---|---|---|---|---|
| NO. | Mg | Cr | Cu | Mo | Nb | B | (%) | REMARKS |
| 1 | 0.0031 | | | | | | 0.352 | EXAMPLE |
| 2 | 0.0035 | | | | 0.010 | | 0.376 | |
| 3 | 0.0041 | | | | | | 0.366 | |
| 4 | 0.0048 | | | 0.04 | | 0.0009 | 0.383 | |
| 5 | 0.0018 | | | | | | 0.391 | |
| 6 | 0.0025 | | 0.20 | | | 0.0005 | 0.409 | |
| 7 | 0.0020 | 0.10 | | 0.03 | | 0.0004 | 0.417 | |
| 8 | 0.0015 | 0.10 | 0.10 | | | | 0.408 | |
| 9 | 0.0014 | 0.19 | 0.32 | | | 0.0011 | 0.375 | |
| 10 | 0.0030 | | 0.20 | | 0.020 | 0.0012 | 0.360 | |
| 11 | 0.0025 | | | | | | 0.403 | |
| 12 | 0.0006 | | | 0.02 | | | 0.370 | |
| 13 | 0.0025 | | | | 0.037 | | 0.426 | |
| 14 | 0.0009 | 0.42 | | | | 0.0008 | 0.496 | |
| 15 | 0.0012 | | 0.31 | 0.19 | | | 0.410 | |
| 16 | 0.0020 | | | | | | 0.410 | |
| 17 | 0.0024 | 0.25 | | 0.20 | | 0.0011 | 0.397 | |
| 18 | 0.0019 | 0.10 | | | 0.010 | | 0.488 | COMPARATIVE |
| 19 | 0.0022 | 0.15 | 0.10 | 0.07 | | | 0.353 | EXAMPLE |
| 20 | 0.0015 | | | | | 0.0005 | 0.391 | |
| 21 | 0.0017 | 0.11 | | | | | 0.486 | |
| 22 | 0.0021 | | 0.21 | 0.03 | | | 0.396 | |
| 23 | 0.0015 | | 0.20 | | | | 0.392 | |
| 24 | 0.0033 | | | | | | 0.371 | |
| 25 | 0.0026 | | 0.11 | | | | 0.389 | |
| 26 | 0.0002 | | | | | 0.0008 | 0.382 | |
| 27 | 0.0022 | | | | | | 0.287 | |
| 28 | 0.0017 | 0.10 | 0.10 | 0.15 | | 0.0010 | 0.534 | |
| 29 | 0.0021 | 0.32 | 0.34 | 0.20 | | | 0.405 | |
| 30 | 0.0033 | | 0.25 | 0.11 | | | 0.433 | |
| 31 | 0.0020 | 0.09 | 0.19 | | | | 0.429 | |
| 32 | 0.0082 | | 0.14 | | | | 0.396 | |

Blank cells indicate that elements are intentionally not added.
Underlines indicate that values fall outside the range of the present invention.

Figure 3:
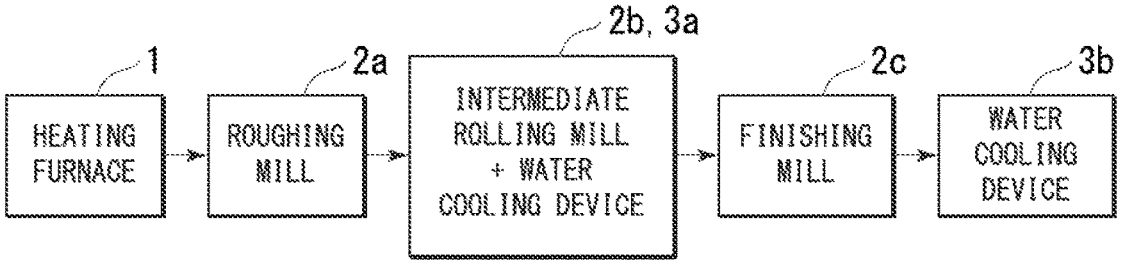
FIG. 3 is a diagram illustrating an example of an apparatus related to a heating process, a hot rolling process, and a cooling process in the process of producing the H-section steel according to the embodiment.

FIG. 3 is a view showing an example of a production apparatus used in the heating process, the hot rolling process, and a cooling process in the production process of the H-section steel.

The hot rolling for hot-rolling the steel pieces heated using heating furnace 1 was performed with a roughing mill 2*a* and then performed with a series of universal rolling apparatuses including an intermediate universal rolling mill and a finishing universal rolling mill. When reverse rolling was employed for intermediate rolling and water cooling between rolling passes was performed, water cooling devices 3*a* provided on front and rear surfaces of an intermediate universal rolling mill (intermediate rolling mill) 2*b* were used. In the example, interpasswater cooling rolling was performed such that the surfaces on the external side of the flange were cooled with spray cooling. The water cooling after controlled rolling was performed in a manner such that, after finish rolling was finished with a finishing universal rolling mill (finishing mill) 2*c*, the surfaces on the external side of the flange were water-cooled with a cooling device (water cooling device) 3*b* provided on the rear surface.

The production conditions are shown in Table 2. In Table 2, the amount of oxygen in the molten steel and the addition order of Mg and Al before Mg was added were shown. The cooling rate in Table 2 is a cooling rate at the strength evaluation portion (position 7 in FIG. 1). However, the cooling rate is not measured directly and is a value calculated from a result of the measurement by attaching a thermocouple to the portion at the measurement through heating with the same size separately performed in an off-line manner and based on the prediction through a computer simulation, and a water cooling start temperature, a water cooling stop temperature, and an application time.

TABLE 2

| PRODUCTION NO. | COMPONENT NO. | OXYGEN INMOLTEN STEEL BEFORE Mg ADDITION [ppm] | ADDITION ORDER OF Al AND Mg | FLANGE THICKNESS [mm] | HEATING TEMPERATURE [° C.] | FINISH ROLLING [° C.] | COOLING RATE [° C./s] | RECUPERATED TEMPERATURE [° C.] |
|---|---|---|---|---|---|---|---|---|
| 1 | 1 | 17 | Al, Mg | 140 | 1310 | 905 | 2.8 | 511 |
| 2 | 2 | 20 | Al, Mg | 140 | 1310 | 904 | 3.0 | 327 |
| 3 | 3 | 21 | Al, Mg | 100 | 1310 | 910 | 2.8 | 402 |
| 4 | 4 | 14 | Al, Mg | 100 | 1310 | 949 | 3.2 | 440 |
| 5 | 5 | 17 | Al, Mg | 125 | 1250 | 948 | 3.3 | 637 |
| 6 | 6 | 21 | Al, Mg | 125 | 1300 | 902 | 3.4 | 630 |
| 7 | 6 | 21 | Al, Mg | 125 | 1300 | 750 | 3.1 | 603 |
| 8 | 6 | 21 | Al, Mg | 125 | 1300 | 900 | 3.1 | 201 |
| 9 | 6 | 21 | Al, Mg | 125 | 1300 | 898 | 3.2 | 742 |
| 10 | 6 | 77 | Mg, Al | 125 | 1300 | 884 | 3.1 | 597 |
| 11 | 7 | 40 | Al, Mg | 100 | 1150 | 891 | 4.0 | 590 |
| 12 | 8 | 18 | Al, Mg | 100 | 1150 | 952 | 4.2 | 584 |
| 13 | 9 | 8 | Al, Mg | 100 | 1150 | 947 | 4.3 | 562 |
| 14 | 10 | 11 | Al, Mg | 100 | 1150 | 928 | 4.3 | 543 |
| 15 | 11 | 33 | Al, Mg | 125 | 1250 | 899 | 3.3 | 401 |
| 16 | 12 | 19 | Al, Mg | 125 | 1250 | 880 | 3.2 | 422 |
| 17 | 13 | 9 | Al, Mg | 125 | 1300 | 850 | 3.5 | 649 |
| 18 | 14 | 25 | Al, Mg | 125 | 1300 | 839 | 3.1 | 410 |
| 19 | 14 | 25 | Al, Mg | 125 | 1300 | 747 | 2.5 | 391 |
| 20 | 14 | 25 | Al, Mg | 125 | 1300 | 852 | 3.3 | 134 |
| 21 | 14 | 25 | Al, Mg | 125 | 1300 | 837 | 3.5 | 727 |
| 22 | 14 | 60 | Mg, Al | 125 | 1300 | 841 | 3.2 | 498 |
| 23 | 15 | 15 | Al, Mg | 150 | 1310 | 910 | 2.6 | 610 |
| 24 | 16 | 11 | Al, Mg | 150 | 1310 | 923 | 2.6 | 633 |
| 25 | 17 | 24 | Al, Mg | 140 | 1310 | 932 | 2.7 | 368 |
| 26 | 18 | 10 | Al, Mg | 125 | 1300 | 892 | 3.3 | 550 |
| 27 | 19 | 23 | Al, Mg | 125 | 1300 | 906 | 3.4 | 552 |
| 28 | 20 | 14 | Al, Mg | 125 | 1300 | 883 | 3.6 | 354 |
| 29 | 21 | 4 | Al, Mg | 125 | 1300 | 918 | 3.4 | 343 |
| 30 | 22 | 19 | Al, Mg | 125 | 1300 | 904 | 3.5 | 325 |
| 31 | 23 | 20 | Al, Mg | 125 | 1300 | 919 | 2.9 | 398 |
| 32 | 24 | 33 | Al, Mg | 100 | 1250 | 882 | 4.5 | 634 |
| 33 | 25 | 34 | Al, Mg | 100 | 1250 | 904 | 4.4 | 524 |
| 34 | 26 | 18 | Al, Mg | 125 | 1300 | 889 | 3.0 | 640 |
| 35 | 27 | 13 | Al, Mg | 125 | 1300 | 903 | 3.3 | 626 |
| 36 | 28 | 40 | Al, Mg | 125 | 1300 | 920 | 3.4 | 583 |
| 37 | 29 | 31 | Al, Mg | 125 | 1300 | 901 | 3.3 | 550 |
| 38 | 30 | 28 | Al, Mg | 125 | 1300 | 898 | 3.4 | 529 |
| 39 | 31 | 36 | Al, Mg | 125 | 1300 | 905 | 3.2 | 604 |
| 40 | 32 | 30 | Al, Mg | 125 | 1300 | 920 | 3.3 | 505 |

Underlines indicate that values fall outside the range of the present invention.

A sample used for a tensile strength test and measurement of the area fraction of bainite was taken from the strength evaluation portion 7 shown in FIG. 1. Using this sample, the yield strength and the tensile strength were evaluated and measure the area fraction of bainite. In addition, a sample used for a Charpy test and measurement of the austenite grain size was taken from the toughness evaluation portion 8 shown in FIG. 1. Using this sample, the toughness was evaluated and the austenite grain size (prior austenite grain size), and the particle size and number density of inclusions were measured. $t_1$ represents a web thickness, $t_2$ represents a flange thickness. F represents a flange length, and H represents a height.

The tensile strength test was performed according to JIS Z 2241. When a sample showed yielding behavior, the yield point was obtained as YS. When the sample did not show yielding behavior, the 0.2% proof strength was obtained as YS. The Charpy impact test was performed at a test temperature of 21° C. according to JIS Z 2242. Further, the metallographic structure was observed using an optical microscope or EBSP to measure the austenite grain size and the area fraction of bainite. In the measurement of the austenite grain size, an optical microscope photograph or an EBSP image was visually observed and the number of (prior) austenite grains present in the entire visual field of 2 mm square was counted (the number of the austenite grain on the visual field boundary was counted as 0.5). The area fraction per austenite grain was calculated and converted into an equivalent circle diameter.

In the measurement of the area fraction of bainite, straight lines of 20 lines×20 lines were drawn vertically and horizontally at a pitch of 50 μm in the optical microscope photograph and whether or not bainite was present at the position of each lattice point was visually determined. The number of lattice points determined as bainite was divided by the total number of lattice points (400) to obtain the area fraction of bainite. Further, the structure of the remainder was specified. The structure of the remainder included one or more of ferrite, pearlite, and MA.

The results are shown in Table 3. YS in Table 3 represents an yield point or 0.2% proof strength at normal temperature. The target values of the mechanical properties are set as follows: the yield strength or 0.2% proof strength (YS) at normal temperatures is set to 450 MPa or more; and the tensile strength (YS) is set to 550 MPa to 680 MPa. Further, the Charpy absorbing energy ($vE_{21}$) at 21° C. is set to 100 J or more.

TABLE 3

| | STRENGTH EVALUATION PORTION | | | TOUGHNESS EVALUATION PORTION (SEGREGATION PORTION) | | | |
|---|---|---|---|---|---|---|---|
| PRODUCTION NO. | AREA FRACTION OF BAINITE [%] | YS [MPa] | TS [MPa] | AUSTENITE GRAIN SIZE [μm] | (Mg, Mn)S DENSITY [$10^5$ pieces/mm$^2$] | vE21* C [J] | REMARKS |
| 1 | 90 | 495 | 636 | 147 | 11.3 | 201 | EXAMPLE |
| 2 | 91 | 460 | 595 | 139 | 53.0 | 189 | |
| 3 | 90 | 483 | 623 | 131 | 88.2 | 191 | |
| 4 | 92 | 464 | 598 | 122 | 32.4 | 180 | |
| 5 | 86 | 469 | 598 | 120 | 13.1 | 215 | |
| 6 | 93 | 480 | 614 | 127 | 18.3 | 240 | |
| 7 | 72 | 437 | 543 | 100 | 15.5 | 232 | COMPARATIVE |
| 8 | 94 | 545 | 691 | 140 | 22.1 | 77 | EXAMPLE |
| 9 | 74 | 430 | 540 | 134 | 10.9 | 239 | |
| 10 | 92 | 491 | 622 | 192 | 0.7 | 93 | |
| 11 | 89 | 470 | 604 | 125 | 17.2 | 201 | EXAMPLE |
| 12 | 90 | 500 | 642 | 120 | 3.9 | 238 | |
| 13 | 94 | 472 | 592 | 125 | 1.9 | 240 | |
| 14 | 83 | 453 | 583 | 134 | 2.4 | 189 | |
| 15 | 90 | 498 | 642 | 140 | 19.3 | 227 | |
| 16 | 89 | 453 | 582 | 137 | 4.4 | 239 | |
| 17 | 92 | 480 | 612 | 127 | 21.0 | 231 | |
| 18 | 91 | 479 | 608 | 120 | 4.8 | 181 | |
| 19 | 70 | 431 | 546 | 105 | 5.0 | 219 | COMPARATIVE |
| 20 | 94 | 539 | 685 | 131 | 5.6 | 64 | EXAMPLE |
| 21 | 71 | 424 | 550 | 139 | 3.8 | 181 | |
| 22 | 91 | 490 | 627 | 190 | 0.8 | 90 | |
| 23 | 95 | 499 | 632 | 138 | 7.9 | 191 | EXAMPLE |
| 24 | 89 | 480 | 618 | 130 | 11.1 | 210 | |
| 25 | 89 | 474 | 600 | 122 | 27.0 | 224 | |
| 26 | 86 | 453 | 583 | 121 | 13.2 | 56 | COMPARATIVE |
| 27 | 73 | 430 | 549 | 129 | 5.1 | 192 | EXAMPLE |
| 28 | 84 | 457 | 590 | 138 | 2.9 | 54 | |
| 29 | 92 | 484 | 621 | 140 | 5.0 | 60 | |
| 30 | 90 | 461 | 596 | 178 | 0.8 | 89 | |
| 31 | 89 | 458 | 587 | 123 | 19.6 | 44 | |
| 32 | 95 | 497 | 640 | 120 | 5.8 | 27 | |
| 33 | 89 | 463 | 592 | 225 | 0.5 | 48 | |
| 34 | 89 | 467 | 603 | 260 | 0.1 | 69 | |
| 35 | 77 | 425 | 547 | 133 | 12.5 | 88 | |
| 36 | 94 | 540 | 690 | 140 | 9.9 | 60 | |
| 37 | 76 | 431 | 532 | 203 | 0.9 | 79 | |
| 38 | 92 | 479 | 603 | 139 | 54.2 | 67 | |
| 39 | 93 | 468 | 605 | 128 | 19.4 | 80 | |
| 40 | 87 | 470 | 618 | 118 | 77.3 | 47 | |

Underlines indicate that volues fall outside the range of the present invention.

Production Nos. 1 to 6, Production Nos. 11 to 18, and Production Nos. 23 to 25 in Table 3 are Examples and the strength and toughness satisfy the target values. On the other hand, in Production Nos. 7 and 19, the finishing temperature is low and in Production Nos. 9 and 21, the recuperated temperature is high, and bainite is not sufficiently firmed. Thus, the strength is not sufficient. In Production Nos. 7 and 19, the finishing temperature is low and, in Production Nos. 9 and 21, the recuperated temperature is high and bainite is not sufficiently formed. Thus, the strength is not sufficient. In the Production Nos. 8 and 20, the recuperated temperature is low and the strength is high and thus the toughness is deteriorated. Further, since Al is added after Mg is added in the production process of the steel in Production Nos. 10 and 22, Mg-based sulfides are not sufficient and sufficient toughness cannot be obtained.

The C content is large in Production No. 26, the Si content is large in Production No. 28, and the Mn content is large in Production No. 29, and the toughness is deteriorated. Contrarily, the C content is small in Production No. 27 and the $C_{eq}$ is low in Production No. 35, and thus, the strength is not sufficient. Further, in Production No. 36, the $C_{eq}$ is high, and the strength is increased and the toughness is deteriorated. The Ti content is excessive in Production No. 31 and the N content is excessive in Production No. 32, and the toughness is deteriorated due to precipitates. In Production No. 30, the Al content is small. In Production No. 33, the S content is small and in Production No. 34, the Mg content is small. Thus, Mg-based sulfides are not sufficient and toughness cannot be obtained. In Production No. 37, the amount f Mn is small and thus the strength and toughness are not sufficient. In Production No. 38, the S content is large and in Production No. 40, the Mg content is large. Thus, (Mg, Mn)S is coarsened and the toughness is deteriorated. In Production No. 39, since the Al content is large, Al oxides and AlN are coarsened and the toughness is deteriorated.

INDUSTRIAL APPLICABILITY

According to the present invention, it is possible to obtain a high strength ultra thick H-section steel having a flange thickness of 100 mm to 150 mm, a yield strength or 0.2% proof strength of 450 MPa or more, and a tensile strength of 550 MPa or more. The high strength ultra thick H-section steel according to the present invention can be produced without adding a large amount of alloys or reducing carbon to the ultra low carbon level, which causes significant steel-making loads. Accordingly, this makes it possible to reduce production costs and shorten production time, thereby achieving a significant reduction in costs. That is, according to the above aspects of the present invention, the reliability of large buildings can be improved without sacrificing cost efficiency, and hence, the present invention makes an extremely significant contribution to industries.

BRIEF DESCRIPTION OF THE REFERENCE SYMBOLS

1: HEATING FURNACE
2*a*: ROUGHING MILL
2*b*: INTERMEDIATE ROLLING MILL
2*c*: FINISHING MILL
3*a*: WATER COOLING DEVICES ON FRONT AND REAR SURFACES OF INTERMEDIATE ROLLING MILL
3*b*: COOLING DEVICE ON REAR SURFACE OF FINISHING MILL
4: H-SECTION STEEL
5: FLANGE
6: WEB
7: STRENGTH EVALUATION PORTION
8: TOUGHNESS EVALUATION PORTION
F: ENTIRE FLANGE LENGTH
H: HEIGHT
$t_1$: WEB THICKNESS
$T_2$: FLANGE THICKNESS

The invention claimed is:

1. An H-section steel comprising, as a chemical composition, by mass %:
C: 0.05% to 0.16%;
Si: 0.01% to 0.50%;
Mn: 0.80% to 2.00%;
Ni: 0.05% to 0.50%;
V: 0.01% to 0.20%;
Al: 0.005% to 0.100%;
Ti: 0.005% to 0.030%;
N: 0.0010% to 0.0200%;
S: 0.002% to 0.02%;
Mg: 0.0005% to 0.005;
Cr: 0% to 0.50%;
Cu: 0% to 0.50%;
Mo: 0% to 0.20%;
Nb: 0% to 0.05%;
B: 0% to 0.0020%, and
a remainder consisting of Fe and impurities,
wherein $C_{eq}$ obtained by the following Equation 1 is 0.35% to 0.50%,
a thickness of a flange is 100 mm to 150 mm,
an area fraction of bainite in a steel structure at a strength evaluation position which is at a ⅙ position from a surface of the flange in a length direction and at a ¼ position from the surface in a thickness direction is 80% or more,
yield strength or 0.2% proof strength is 450 MPa or more, and tensile strength is 550 MPa or more and 680 MPa or less at the strength evaluation position,
an average austenite grain size in a steel structure at a toughness evaluation position which is at a ½ position from the surface of the flange in the length direction and at a ¾ position from the surface in the thickness direction is 150 μm or less, and
(Mg, Mn)S having a particle size of 0.005 μm to 0.5 μm is included at a density of $1.0\times10^5$ pieces/mm to $1.0\times10^7$ pieces/mm$^2$,
the (Mg, Mn)S includes, by mass %, 20% to 80% of Mn, 20% to 80% of Mg, and a remainder, and a ratio of S with respect to a total mass of S and O in the remainder is, by mass %, 50% to 100%, $$C_{eq}=C+Mn/6+(Cr+Mo+V)/5+(Ni+Cu)/15 \quad \text{Equation 1}$$

here, C, Mn, Cr, Mo, V, Ni, and Cu represent the amount of each element contained by mass % and the amount of an element not contained is 0.

2. The H-section steel according to claim 1, comprising, as the chemical composition, by mass %,
one of or two or more of
Cr: 0.01% to 0.50%,
Cu: 0.01% to 0.50%,
Mo: 0.001% to 0.20%,
Nb: 0.001% to 0.05%, and
B: 0.0001% to 0.0020%.

3. A method of producing an H-section steel comprising:
forming (Mg, Mn)S by adding Mn, Mg, and Al to a molten steel and adjusting a chemical composition of the molten steel to include, by mass %, C: 0.05% to 0.16%, Si: 0.01% to 0.50%, Mn: 0.80% to 2.00%, Ni: 0.05% to 0.50%, V: 0.01% to 0.20%, Al: 0.005% to 0.100%, Ti: 0.005% to 0.030%, N: 0.0010% to 0.0200%, S: 0.002% to 0.02%, Mg: 0.0005% to 0.005%, Cr: 0% to 0.50%, Cu: 0% to 0.50%, Mo: 0% to 0.20%, Nb: 0% to 0.05%, B: 0% to 0.0020%, and a remainder consisting of Fe and impurities, and have $C_{eq}$ obtained by the following Equation 2 of 0.35% to 0.50%;
casting the molten steel to obtain steel pieces;
heating the steel piece to 1100° C. to 1350° C.;
performing a rough rolling on the heated steel pieces using a roughing mill and forming the steel pieces into an H-section steel;
performing a reverse rolling on the H-section steel using an intermediate rolling mill;
performing a finish rolling on the H-section steel using a finishing mill so that a rolling finish temperature reaches a surface temperature of 800° C. or higher;
water-cooling the H-section steel; and
recuperating a temperature of the H-section steel so that the surface temperature is within a temperature range of 300° C. to 700° C.,
wherein in the forming of the (Mg, Mn)S, the concentration of O in the molten steel when the Mg is added is 50 ppm or less, and
the reverse rolling in the performing of the reverse rolling is controlled rolling, $$C_{eq}=C+Mn/6+(Cr+Mo+V)/5+(Ni+Cu)/15 \quad \text{Equation 2}$$

here, C, Mn, Cr, Mo, V, Ni, and Cu represent the amount of each element contained by mass % and the amount of an element not contained is 0.

4. The method of producing an H-section steel according to claim 3, wherein the steel includes, as the chemical composition, by mass %, one of or two or more of Cr: 0.01% to 0.50%, Cu: 0.01% to 0.50%, Mo: 0.001% to 0.20%, Nb: 0.001% to 0.05%, and B: 0.0001% to 0.0020%.

* * * * *